US005303922A

United States Patent [19]

Lo

[11] Patent Number: 5,303,922

[45] Date of Patent: Apr. 19, 1994

[54] COMPOSITE GOLF CLUB HEAD

[76] Inventor: Kun-Nan Lo, No. 33, Hsiang-Ho Rd., Li-Lin Tsun, Tan-Tzu Hsiang, Taichung Hsien, Taiwan

[21] Appl. No.: 52,184

[22] Filed: Apr. 22, 1993

[51] Int. Cl.[5] ..... A63B 53/04

[52] U.S. Cl. ..... 273/173; 273/167 J

[58] Field of Search ..... 273/167 J, 173, 78, 273/167 H, 167 F, 169, 171, 168, 167 R

[56] References Cited

U.S. PATENT DOCUMENTS

| | | | |
|---|---|---|---|
| 1,525,352 | 2/1925 | Aitken | 273/173 |
| 3,211,455 | 10/1965 | Hyden | 273/173 |
| 3,975,023 | 8/1976 | Inamori | 273/173 |
| 4,573,685 | 3/1986 | Young, IV et al. | 273/173 |
| 5,106,094 | 4/1992 | Desbiolles et al. | 273/173 |
| 5,176,384 | 1/1993 | Sata et al. | 273/78 |

*Primary Examiner*—William H. Grieb
*Assistant Examiner*—Steven B. Wong
*Attorney, Agent, or Firm*—Curtis, Morris & Safford

[57] ABSTRACT

A composite golf head includes a head portion with a striking face, and a striking plate fixed to the striking face of the head portion. The head portion is made of a carbon fiber composite material and the striking plate is made of a wear resistant material. A plurality of first projections extending outwardly from the peripheral edge are adjacent to the inside face of the striking plate. Between each of the first projections and its peripheral edge a shoulder portion is formed. The head portion has a plurality of engaging grooves formed therein which are adjacent to the striking face of the head portion so that the first projections can be received and locked in their respective engaging grooves.

2 Claims, 3 Drawing Sheets

COMPOSITE GOLF CLUB HEAD

BACKGROUND OF THE INVENTION

1. Field of the Invention

This invention relates to a composite golf head, more particularly to a composite golf head which has a carbon fiber head portion and a wear resistant striking plate fixed to said head portion.

2. Description of the Related Art

Conventionally, golf heads are made of metal or carbon fiber composite materials. The metal golf head has good strength and wear resistance. However, its manufacturing costs are high. The golf heads which are made of carbon fiber composite materials have high strength and small specific gravity. The fiber angle of the golf head can be arranged according to the strength and the direction of the striking force. However, the carbon fiber golf heads suffer from having poor wear resistance.

Accordingly, composite golf heads have been developed to overcome the above-mentioned drawbacks. The composite golf head includes a head portion which is made of a carbon fiber composite material and a striking plate which is fixed to the striking face of the head portion and is made of a wear resistant material. The wear resistant material may be stainless steel, titanium alloy, or structural ceramic. When the composite golf head is manufactured, the striking plate is placed in a mold and the carbon fiber composite material is then heated and pressurized in the mold. The striking plate is thus adhered to the striking face of the head portion as the carbon fiber composite material cools and forms. However, because the adhesion force between the head portion and the striking plate is weak, the striking plate is sometimes separated from the head portion when it is in the process of being struck.

SUMMARY OF THE INVENTION

It is therefore a main object of this invention to provide a composite golf head which has a striking plate fixed securely to the head portion.

Accordingly, the composite golf head of this invention includes a head portion with a striking face and a striking plate which is fixed to the striking face of the head portion. The head portion is made of a carbon fiber composite material and the striking plate is made of a wear-resistant material. The striking plate has an inside face, an outside face and a peripheral edge which interconnects the inside and outside faces. A plurality of first projections extend outwardly from the peripheral edge adjacent to the inside face of the striking plate. Between the first projections and the peripheral edge is a shoulder portion. The head portion has a plurality of engaging grooves formed therein adjacent to the striking face of the head portion so that the first projections can be received and locked in their respective engaging grooves.

Other features and advantages of this invention will become apparent in the following detailed description of the preferred embodiment of this invention with reference to the accompanying drawings.

DETAILED DESCRIPTION OF THE PREFERRED EMBODIMENT

Figure 1:
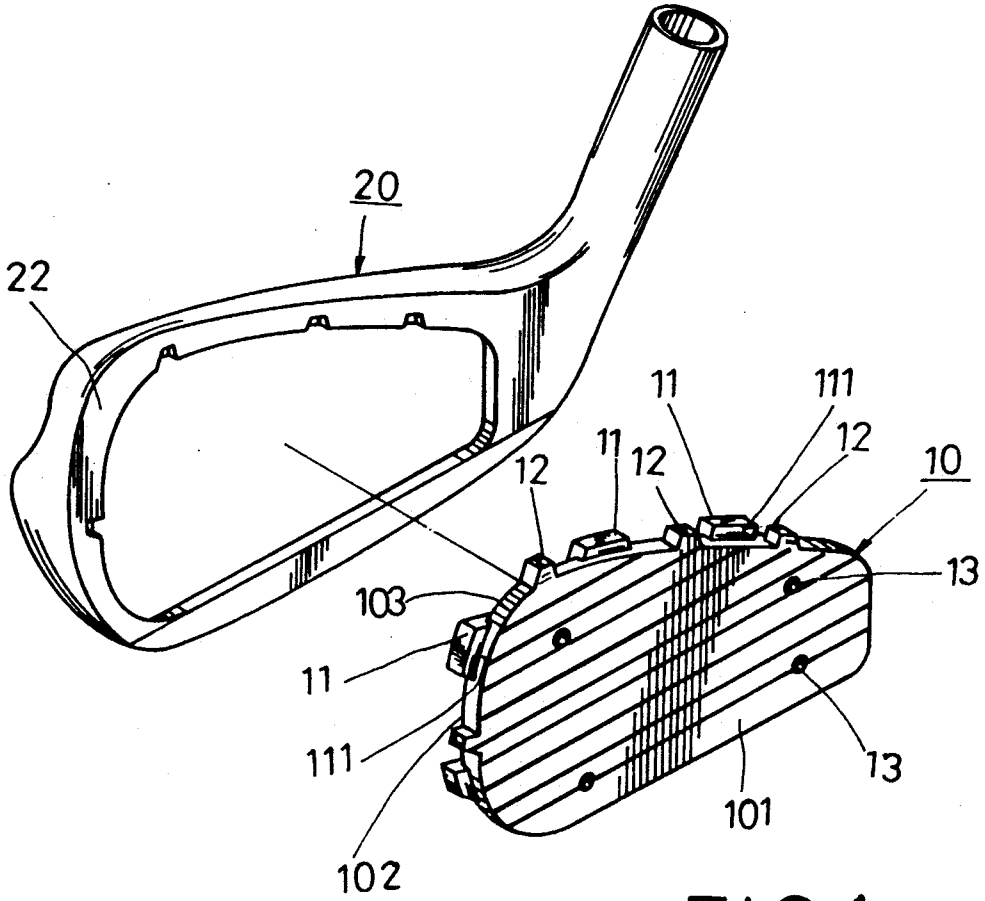
FIG. 1 is an exploded view of a preferred embodiment of a composite golf head of this invention.
Figure 2:
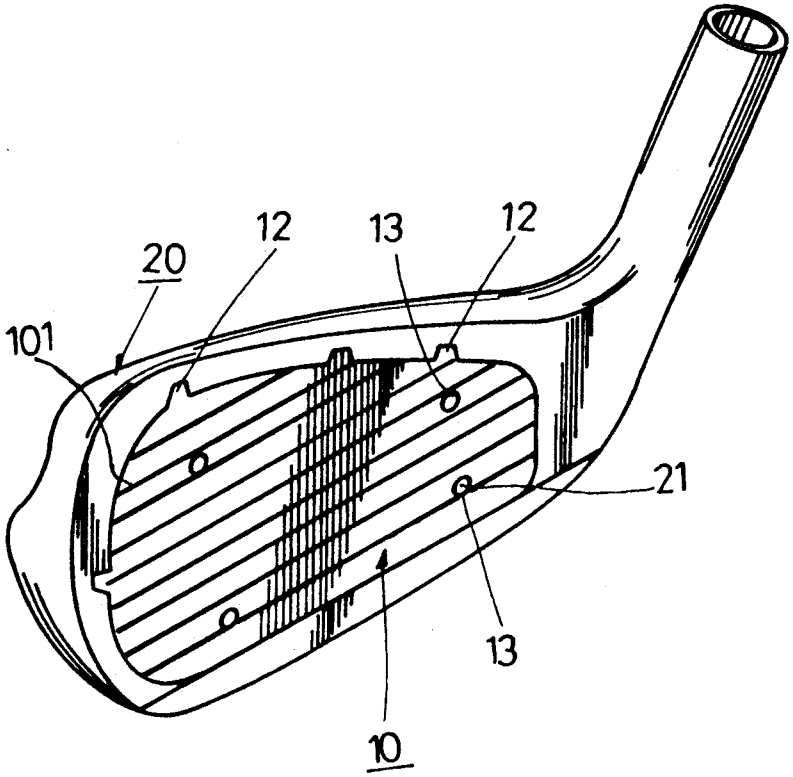
FIG. 2 is a perspective view of the preferred embodiment of the composite golf head of this invention.
Figure 3:
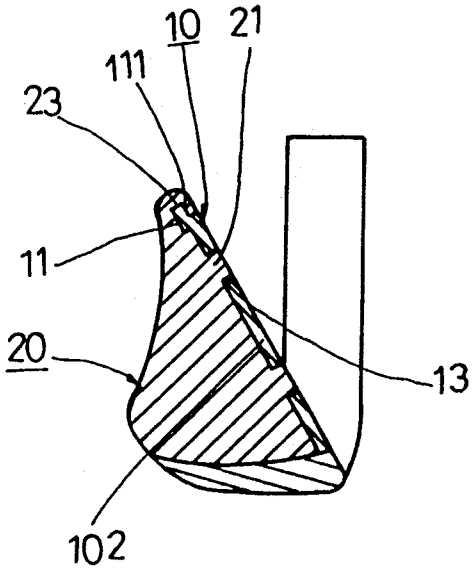
FIG. 3 is a cross sectional view of the preferred embodiment of the composite golf head of this invention.

FIG. 1 shows an exploded view of a preferred embodiment of a composite golf head of this invention. The composite golf head includes a head portion 20 with a striking face 22, and a striking plate 10 to be fixed to the striking face 22 of the head portion 20, as best illustrated in FIG. 2. The head portion 20 is made of a carbon fiber composite material and the striking plate is made of a wear-resistant material such as stainless steel, titanium alloy or structural ceramic. The striking plate 10 has an inside face 102, an outside face 101 and a peripheral edge 103 which interconnects the inside and outside faces, 102 and 101. The striking plate 10 has a thickness of 1.5–3.5 mm. The peripheral edge 103 of the striking plate 10 has a plurality of first projections 11 extending outwardly therefrom. The first projections 11 are formed adjacent to the inside face 102 of the striking plate 10. A shoulder portion 111 is formed between each of the first projections 11 and the peripheral edge 103, as best illustrated in FIGS. 1 and 3.

Furthermore, the peripheral edge 101 of the striking plate 10 further has a plurality of second projections 12 extending outwardly therefrom. Each of the second projections 12 has a thickness which is identical to the thickness of the peripheral edge 103 of the striking plate 10.

Four holes 13 are formed in the striking plate 10. The striking face of the head portion has four pillars 21 extending outwardly therefrom. Pillars 21 fill the correspondingly holes 13 of the striking plate 13, as best illustrated in FIG. 3.

When the golf head of this invention is manufactured, the striking plate 10 is placed in a mold and a carbon fiber composite material is then heated and pressurized in the mold. The head portion 20 and the pillars 21 are formed during the cooling process. It is noted that the first projections of the striking plate 10 securely fastens to the head portion 20 because the first projections 11 are received by a plurality of engaging grooves 23 which are correspondingly formed in the head portion 20 adjacent to the striking face 22 of the head portion 20. The second projections 12 facilitate the positioning of the striking plate 10 in the head portion 20.

With this invention thus explained, it is apparent that numerous modifications and variations can be made without departing from the scope and spirit of this invention. It is therefore intended that this invention be limited only as indicated in the appended claims.

I claim:

1. A composite golf head comprising a head portion with a striking face, and a striking plate affixed to said striking face of said head portion, said head portion being made of a carbon fiber composite material, said striking plate being made of a wear resistant material; the improvements comprising:

said striking plate having an inside face, an outside face and a peripheral edge which interconnects said inside and outside faces, and a plurality of first projections extending outwardly from said peripheral edge adjacent to said inside face of said striking plate, each of said first projections forming a shoulder portion and said peripheral edge, said head portion having a plurality of engaging grooves formed therein adjacent to said striking face of said head portion so that said first projections can be received and locked in their respective engaging grooves, and said peripheral edge has a plurality of second projections extending outwardly therefrom, each of said second projections having a thickness identical to said thickness of said peripheral edge.

2. A composite golf head as claimed in claim 1, wherein said striking plate has a plurality of holes formed therein, and wherein said striking face of said head portion has a plurality of pillars extending outwardly therefrom, said pillars filling correspondingly said holes of said striking plate.

* * * * *